US007766673B1

(12) United States Patent
Dumont et al.

(10) Patent No.: US 7,766,673 B1
(45) Date of Patent: Aug. 3, 2010

(54) FUSIBLE LINK BUSBAR FOR STARTER AND ALTERNATOR WITH DUAL BATTERY APPLICATION

(75) Inventors: Jeffrey Dumont, Farmington Hills, MI (US); Michael Dinsmore, Farmington Hills, MI (US); James Beach, Farmington Hills, MI (US)

(73) Assignee: Nissan Technical Center North America, Inc., Farmington Hills, MI (US)

( * ) Notice: Subject to any disclaimer, the term of this patent is extended or adjusted under 35 U.S.C. 154(b) by 0 days.

(21) Appl. No.: 12/533,491

(22) Filed: Jul. 31, 2009

(51) Int. Cl.
*H01R 12/00* (2006.01)

(52) U.S. Cl. ..... 439/76.2; 439/907

(58) Field of Classification Search ..... 439/76.2, 439/907, 500, 34
See application file for complete search history.

(56) References Cited

U.S. PATENT DOCUMENTS

| | | | | |
|---|---|---|---|---|
| 6,461,172 | B2 * | 10/2002 | Ross | 439/78 |
| 6,603,283 | B2 | 8/2003 | Yuasa et al. | |
| 6,902,434 | B2 | 6/2005 | Stack | |
| 6,922,331 | B2 | 7/2005 | Ikeda | |
| 2004/0048142 | A1 | 3/2004 | Marusak et al. | |

* cited by examiner

*Primary Examiner*—Tho D Ta
(74) *Attorney, Agent, or Firm*—Young Basile

(57) ABSTRACT

An electrical coupling for electrically linking at least one battery to an actuator in a vehicle includes a housing having a base including at least two spaced apart connectors. A busbar has a first conductive portion, a second conductive portion spaced from the first conductive portion, and a fuse portion connecting the first and second conductive portions. The first conductive portion has at least two spaced apart junctions and the second conductive portion has at least one junction. The busbar is sized and configured to fit in the housing in at least a first position and a second position in which the busbar is rotated relative to the first position.

20 Claims, 7 Drawing Sheets

FIG. 4
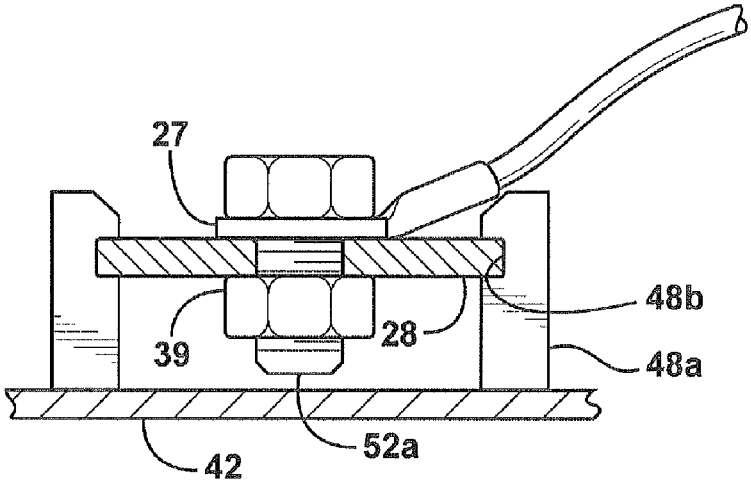
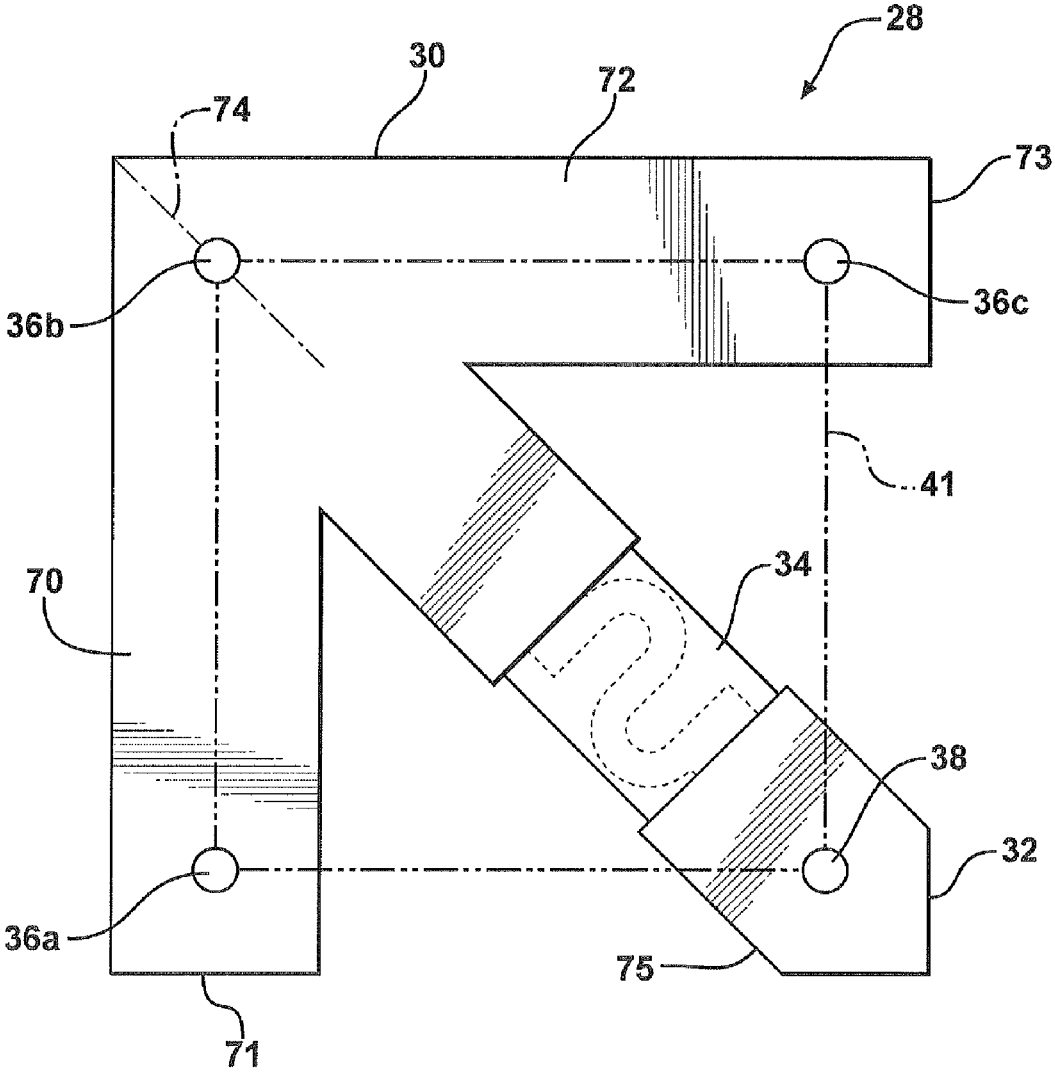
FIG. 5

FUSIBLE LINK BUSBAR FOR STARTER AND ALTERNATOR WITH DUAL BATTERY APPLICATION

FIELD OF THE INVENTION

The invention relates to an electrical system for a vehicle, and more particularly an electrical system for electrically connecting an alternator to at least one battery in a vehicle.

BACKGROUND OF THE INVENTION

Engines in some vehicles, such as diesel engines in light commercial vehicles, may require high amounts of power to start. To provide a sufficient amount of power, many such vehicles include a starter powered by two batteries. When two batteries are used in a vehicle, a battery fuse terminal (BFT) is typically fixed to a terminal of a first of the two batteries, and a long wire typically extends from a terminal of a second one of the two batteries to the BFT. A power distribution board can be electrically coupled to the BFT, and separate wires can extend from the BFT or power distribution board to a starter for starring the engine and an alternator for recharging batteries. A fuse, such as a fusible link, can be included in the power BFT or elsewhere along an electrical path between the batteries and the alternator in order to protect the alternator from a surge of current.

SUMMARY

In known dual battery systems for vehicles, a second battery is attached to a battery fuse terminal (BFT) that is fixed to a terminal of a first battery. Known dual battery systems can be problematic for various reasons. For example, a long wire is typically used to electrically connect the second battery to the BFT. To effectively transfer power from the second battery, the long wire has a large diameter, and such wiring is typically very expensive. As another example, the amount of resistance from the starter and alternator to each of the batteries differs. For example, the amount of resistance between the first battery and each of the starter and alternator is often less than the amount of resistance between the second battery and each of the starter and alternator because the second battery has the additional resistance of the long wire used to connect it to the power distribution board.

Examples of an electrical system including, an electrical coupling as described herein can overcome the problems associated with known dual battery systems. In one example, an electrical coupling for transferring power between a pair of batteries, an alternator, and a starter in a vehicle is described. The electrical coupling features a housing including at least one busbar retainer. A busbar has a first conductive portion, a second conductive portion spaced from the first conductive portion, and a fuse portion connecting the first and second conductive portions. The first conductive portion has at least two spaced apart junctions and the second conductive portion has at least one junction. The busbar is sized and configured, to fit in the housing and engage the at least one busbar retainer in at least a first position and a second position in which the busbar is rotated relative to the first position by a prescribed angle about an axis that is perpendicular to an imaginary plane defined by the junctions.

In another example, an electrical system is described. The electrical system includes a busbar defining a first conductive portion having at least two spaced apart first junctions, a second conductive portion spaced from the first conductive portion and defining at least one second junction, and a fuse portion joining the first conductive portion to the second conductive portion. At least one battery is coupled to one of the first junctions, and an alternator is coupled to the second junction and, operable to charge the at least one battery via the electric junction.

In yet another example, an electrical system for a vehicle is described. The electrical system includes a first battery and a second battery spaced from the first battery. An electric junction is disposed between the first and second batteries. A first wire couples the first battery to the electric junction, and a second wire couples the second battery to the second junction. The second wire is of substantially equal length as the first wire. An alternator is coupled to the electric junction and operable to recharge the first and second batteries via the first and second wires. A starter is coupled to the electric junction and operable to draw power from the first and second batteries via the first and second wires.

BRIEF DESCRIPTION OF THE DRAWINGS

The description herein makes reference to the accompanying drawings wherein like referenced numerals refer to like parts throughout the several views, and wherein:

FIG. 4 is a cross-section view taken along line 4-4 in FIG. 2;

FIG. 5 is a top plan view of the busbar of FIG. 2;

DETAILED DESCRIPTION

Figure 1:
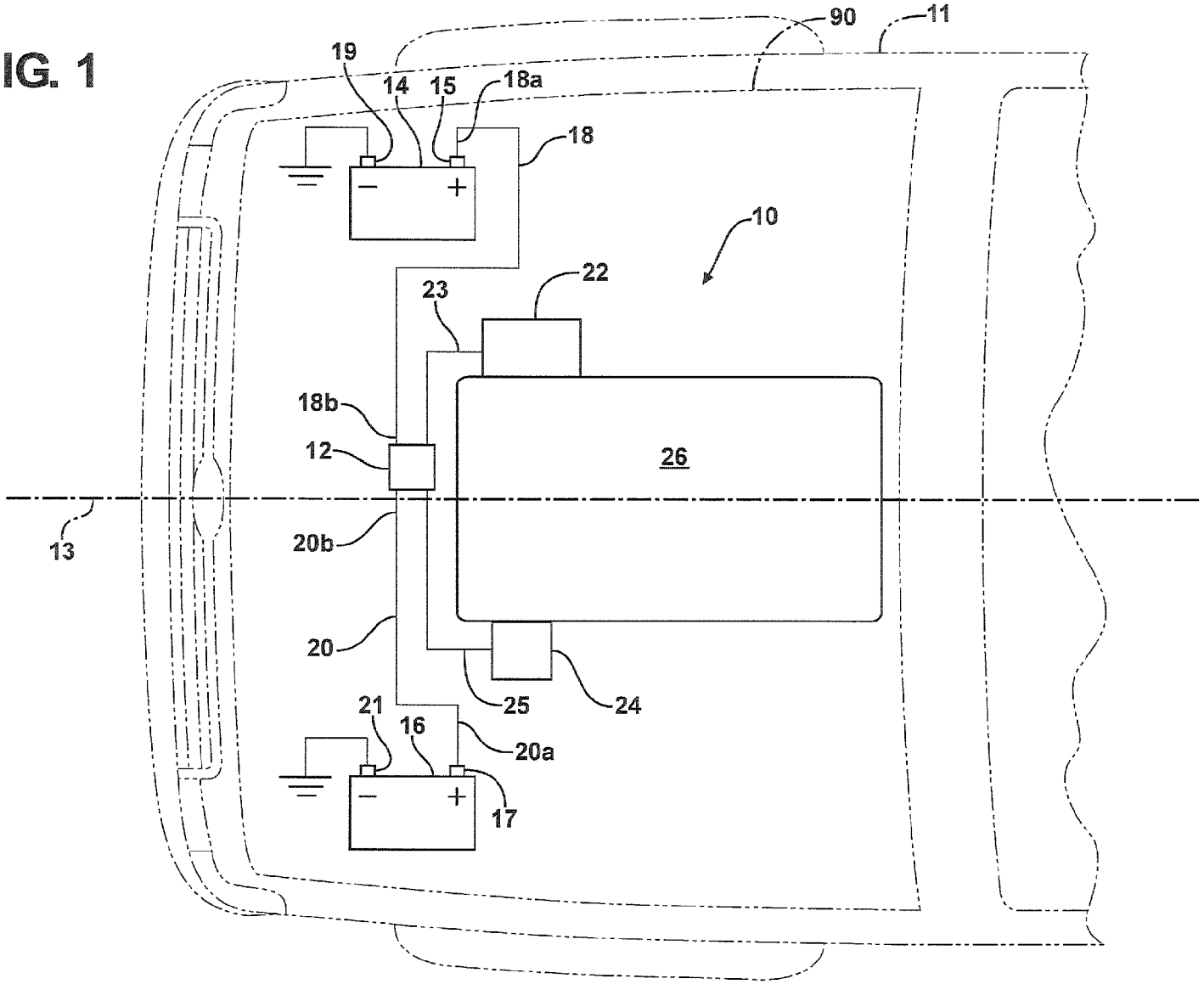
FIG. 1 is a schematic view of an example of an electric system for a vehicle.

Examples of an electrical system for a vehicle are described herein with reference to FIGS. 1-10. As shown in FIG. 1, a vehicle 11 includes an electrical system 10. The vehicle 11 can be a light commercial vehicle, such as a diesel truck, or another type of vehicle. The electrical system 10 or a portion thereof can be disposed in an engine compartment 90 of the vehicle 11, though the electrical system 10 can be disposed at another location in or on the vehicle 11.

The electrical system 10 can include an electric junction 12, a first battery 14, a second battery 16, a starter 22, an alternator 24, and an engine 26, which can be a diesel engine or another type of engine. The batteries 14 and 16 can both be 12V lead-acid type batteries, though other types of batteries such as lithium-ion batteries can be used, and the batteries 14 and 16 can be of different types and/or powers. The batteries 14 and 16 can be disposed on opposite sides of the engine compartment 90 of the vehicle 11. The batteries 14 and 16 can be disposed at positions counter-balanced relative to, or equidistance from, a fore-aft centerline 13 of the vehicle 11. The batteries 14 and 16 can have respective positive terminals 15 and 17 and respective negative terminals 19 and 21. Alternatively, the electric system 10 can include only one of the batteries 14 and 16 or more than the two batteries 14 and 16.

The electric junction 12 can be approximately mid-way between the first and second batteries 14 and 16, and the first and second batteries 14 and 16 can be electrically coupled to the electric junction 12. In the example shown in FIG. 1, the batteries 14 and 16 are electrically coupled to the electric junction 12 by first and second, wires 18 and 20, respectively. The wires 18 and 20 can have respective first ends 18*a* and 20*a* and respective second ends 18*b* and 20*b*. The first ends 18*a* and 20*a* can be electrically coupled to the respective positive terminals 15 and 17 of the first and second batteries 14 and 16. For example, the first ends 18*a* and 20*a* can be connected directly to the respective positive terminals 15 and 17, such as by being held in connection with the terminals 15 and 17 by threaded nuts. As another example, the first ends 18*a* and 20*a* of the wires 18 and 20 can be connected to power distribution boards that are connected to the positive terminals 15 and 17, respectively. The second ends 18*b* and 20*b* of the batteries 14 and 16, respectively, can be coupled to the electric junction 12 as is described below in greater detail. The negative terminals 19 and 21 of the respective batteries 14 and 16 can be ground, such as by being electrically connected to a chassis of the vehicle 11 using wires.

The wires 18 and 20 can have substantially the same length such that the electric resistance between the electric junction 12 and each of the batteries 14 and 16 is substantially the same. Positioning the electric junction 12 approximately mid-way between the batteries 14 and 16 can allow the junction 12 to be electrically connected to each battery 14 and 16 with wires 18 and 20 of equal length while keep the aggregate length of the wires 18 and 20 small. Further having substantially the same resistance between the electric junction 12 and each of the batteries 14 and 16 can allow the batteries 14 and 16 to output substantially equal mounts of current to the electric junction 12 and receive substantially equal amounts of current from the electric junction 12. As a result, the batteries 14 and 16 can be drained at substantially the same rate and recharged at substantially the same rate. Having substantially the same resistance between each of the batteries 14 and 16 and the electric junction 12 can thus reduce the likelihood that a large charge disparity will develop between the batteries 14 and 16, such as one of the batteries 14 or 16 dying while the other battery 14 or 16 has a substantial charge remaining.

The starter 22 and alternator 24 can also be electrically coupled to the electric junction 12. In the example shown, wires 23 and 25 extend from the electric junction 12 and are connected to the starter 22 and alternator 24, respectively. The starter 22 and alternator 24 can be operatively coupled to the engine 26. For example, the starter 22 can be an electric motor that initiates rotational motion in the engine 26 when actuated, and the alternator 24 can be mechanically coupled to the engine 26 to convert mechanical energy produced by the engine 26 to electricity.

As a result of being electrically coupled to the electric junction 12, the starter 22 can receive power from the batteries 14 and 16 to start the engine 26. Once the engine 26 is operating, the alternator 24 can produce electricity, which it can transfer to the batteries 14 and 16 via the electric junction 12. Also, other devices, such as a power distribution board that is electrically coupled to various electric devices in the vehicle 11 (e.g., powered seats, powered mirrors, powered windows, and/or a radio), can also be electrically coupled to the electric junction 12 to receive electricity from the alternator 24 and/or the batteries 14 and 16.

Figure 2:
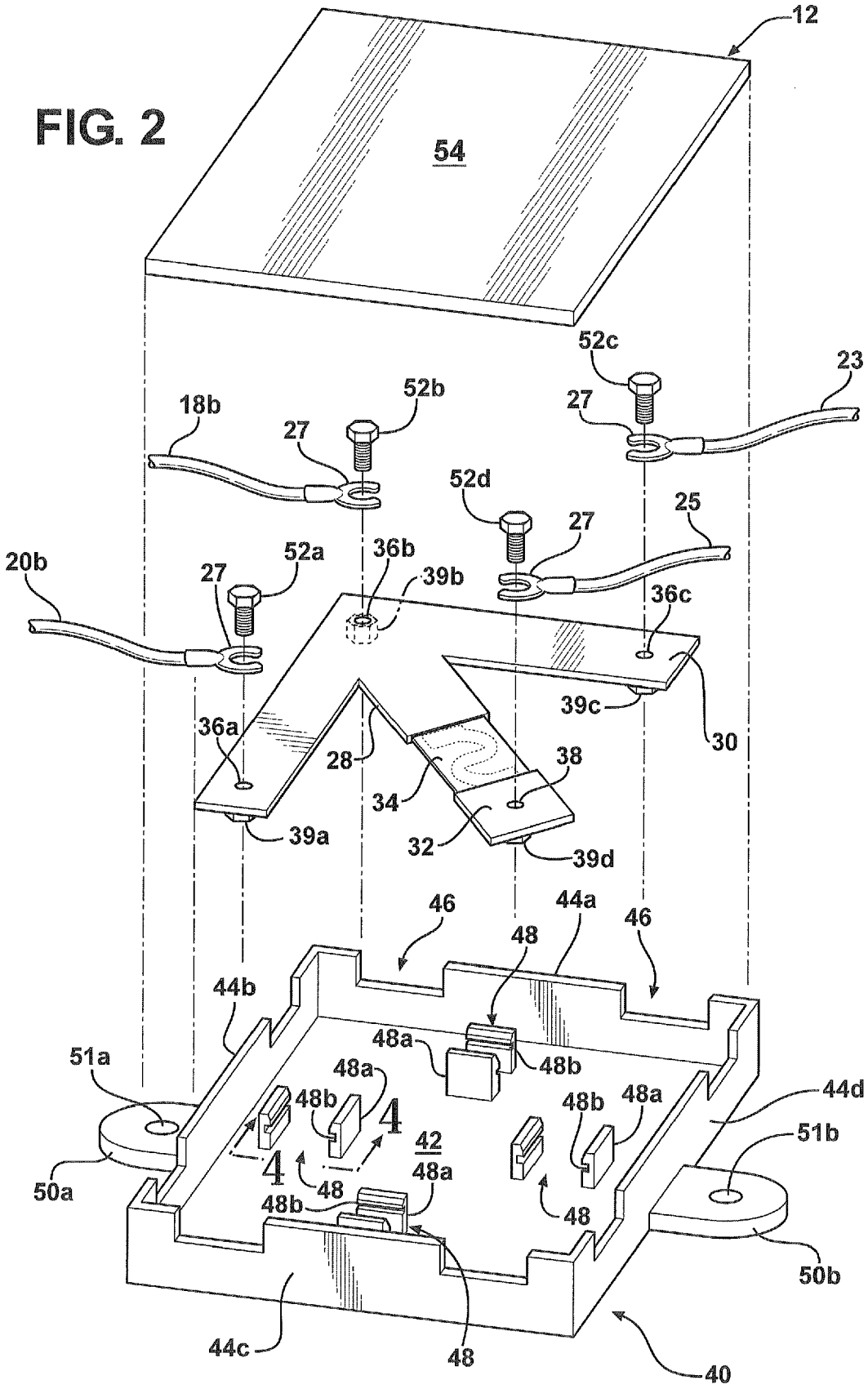
FIG. 2 is an exploded perspective view of an example of an electric junction including a busbar and a housing.
Figure 3:
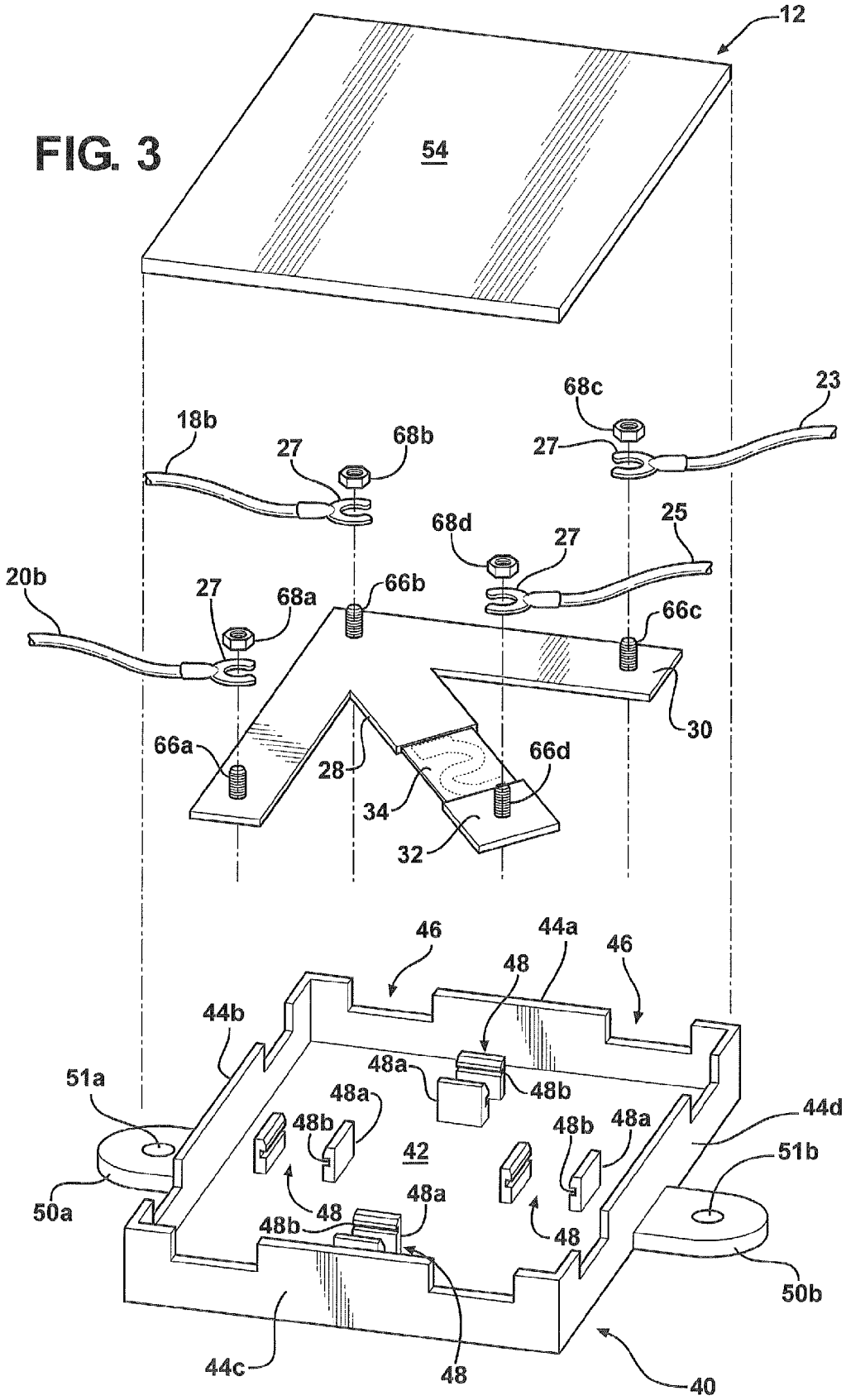
FIG. 3 is an exploded perspective view of another example of an electric junction.

As shown in FIG. 2, the electric junction 12 can include a busbar 28 and a housing 40 for at least partially enclosing the busbar 28. The busbar 28 can include a first conductive portion 30 and a second conductive portion 32 that is spaced from the first conductive portion 30 but connected thereto by fuse portion 34. The first conductive portion 30 and second conductive portion 32 can be sheet-like pieces of a conductive material such as copper, aluminum, or another material. The fuse portion 34 can physically and electrically connect the first and second conductive portions 30 and 32 during normal operation, and the fuse portion 34 can electrically disconnect the first and second conductive portions 30 and 32 in response to a current of greater than a predetermined amount flowing through the fuse portion 34 (in other words, the fuse portion 34 can become blown if too great a current passes therethrough). The predetermined amount of current can be an amount of current which the alternator 24 can safely handle, but above which there is a risk that the alternator 24 will become damaged. While the busbar 28 is shown as an integral part, it can alternatively include two or more separate pieces that are electrically connected to one another, for example, via a wire or as a result of being in physical contact with one another.

The busbar 28 can additionally include three first junctions on the first conductive portion 30. The first junctions can be structure that enable electrical connection of wires 18, 20 and 23 to the busbar 28. For example, as shown as in FIG. 2, the first junctions include apertures 36*a*, 36*b* and 36*c* formed in the busbar 28, threaded nuts 39*a-c* aligned with the apertures 36*a*, 36*b* and 36*c* on a bottom side of the busbar 28, and bolts 52*a-c* that can be threaded into engagement with the nuts 39*a-c*. The busbar 28 can additionally include a second junction on the second conductive portion 32, shown in FIG. 2 as aperture 38, another threaded nut 39*d* aligned with aperture 38, and a bolt 52*d*. Each nut 39*a-d* can be attached to the busbar 28, such as by welding the nuts 39*a-d* to the busbar 28. Alternatively, the nuts 39*a-d* can be held against the busbar 28 by engaging the nuts 39*a-d* with their respective bolts 52*a-d*. Also, the junctions can have an alternative structure that allow the busbar 28 to be electrically coupled to the wires 18, 20, 23 and 25 from shown in FIG. 2 such as studs, clips, or solder pads. For example, the busbar 28 shown FIG. 3 has threaded studs 66*a-d* welded thereon to create junctions, and nuts 68*a-d* can be threaded onto the respective studs 66*a-d* to electrically hold wires 18, 20 and 23 in contact with the first conductive portion 30 of the busbar and wire 25 in contact with the second conductive portion 32 as is described below in greater detail. Also, greater or fewer than three first junctions and more than one second junction can be included on the busbar 28.

Figure 10:
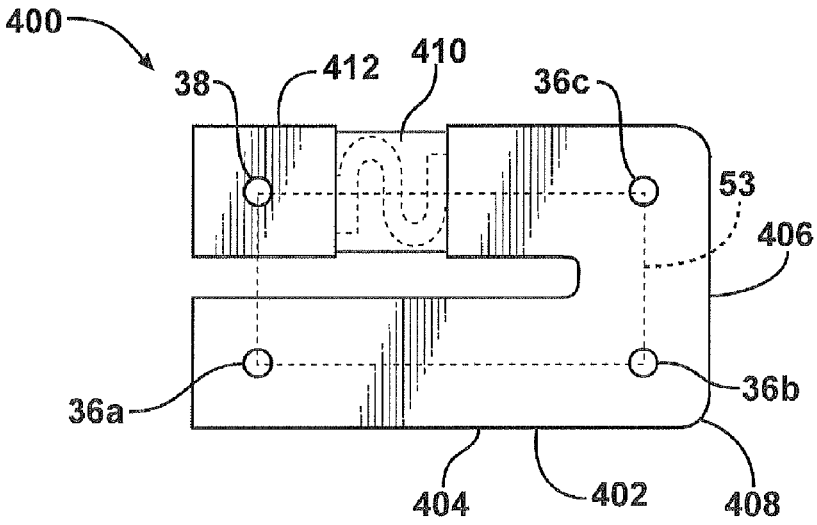
FIG. 10 is a top plan view of still a further example of a busbar.

The four junctions of the busbar 28 (e.g., apertures 36*a*, 36*b*, 36*c* and 38, nuts 39*a-d* and bolts 52*a-d* in the example shown in FIG. 2) can be disposed at positions that define corners of an imaginary planar square 51 in FIG. 5, though the junctions can also be disposed another positions such as defining corners of a rectangle 53 shown in FIG. 10. The junctions being arrange to define a square can allow the junctions to occupy predetermined positions (e.g., positions near apertures or openings 46 in the housing 40) regardless of the orientation of the busbar 28.

Referring now to FIG. 5 to describe the busbar 28 in greater detail, the first conductive portion 30 of the busbar 28 can include a pair of arms 70 and 72 that are approximately orthogonal to one another. The arms 70 and 72 can meet at an intersection 74. The fuse portion 34 can extend from the intersection 74 between the arms 70 and 72. The fuse portion 34 can extend at an acute angle, such as a forty five degree angle as shown in FIG. 5, to each of the arms 70 and 74. Each arm 70 and 72 can have a distal end 71 and 73, respectively.

One first junction including aperture 36*a* can be located near the distal end 71 of the arm 70, another first junction including aperture 36*b* can be located near the intersection 74, and yet another first junction including aperture 36*c* can be located near the distal end 73 of the arm 72. The second conductive portion 32 can have a distal end 75, and the second junction including aperture 38 can be located near that distal end 75.

Referring back to FIG. 2, the housing 40 can include a planar base 42 and four sidewalls 44*a-d* extending orthogonally from respective sides of the base 42 and oriented orthogonal to adjacent sidewalls 44*a-d*. Each sidewall 44*a-d* can include a pair of spaced openings 46, with the openings 46 disposed near opposing ends of each sidewall 44*a-d* (e.g., near the junctions of the sidewalls 44*a-d*). The openings 46 can allow wires 18, 20, 23 and 25 to extend from external of the housing 40 to the busbar 28. Further, the inclusion of two openings 46 on each sidewall 44*a-d* results in openings 46 being oriented orthogonally to one another near each corner of the housing 40, which in turn can allow the wires 18, 20, 23 and 25 to selectively enter the housing 40 from different directions. For example, the wire 18 can enter the housing 40 through the opening 46 in wall 44*a* or the opening in wall 44*b* for attachment to junction 36*b* when the busbar 28 is positioned as shown in FIG. 2. The openings 46 through which the wires 18, 20, 23 and 25 pass can be selected for an easy connection to the busbar 28 regardless of the orientation of the busbar 28 within the housing 40.

The base 42 can also define include one or more busbar retainers for attaching the busbar 28 to the housing 40. In the example shown in FIG. 2, the busbar retainers include four clips 48, with clip 48 including two opposing stems 48*a* projecting from the base 42 and each defining a slot 48*b* having a height substantially equal to a thickness of the busbar 28. The distance between the stems 48*a* of each pair of clips 48 can be slightly less than a width of the arm 70 or 72 of the busbar 28, while back walls of the slots 48*a* can be spaced apart by the width of the arm 70 or 72 of the busbar or slightly greater. As a result, the busbar 28 can be forced toward the base 42, thereby biasing the clips 48 until the busbar 28 reaches the slots 48*b* and becomes engaged with the clips 48. Note that the busbar 28 need not be engaged with each clip 48 when attached to the housing 40. For example, the busbar 28 can be engaged to only two of the four clips 48 in the illustrated example, and the specific clips 48 that the busbar 28 is engaged with can depend on the position of the busbar 28. Alternatively, the housing 40 can include a different number of clips, such as two clips 48. As another alternative, instead of or in addition to clips 48, the housing 40 can include other busbar retainers such as an elastic membrane lining the sidewalls 44*a-d* of the housing 40 for receiving the busbar 28 in a friction fit, another type of snap-fit, or adhesive. As is described below in greater detail with reference to FIG. 6, the busbar 28 can be arranged in different positions when engaged with the housing 40.

The wires 18, 20 and 23 extending from the batteries 14 and 16 and the starter 22, respectively, can be connected to respective first junctions on the first conductive portion 30 of the busbar 28, and the wire 25 extending from the alternator 24 can be connected to the second, junction 38 on the second conductive portion 32. Connecting the alternator 24 to the second junction 38 results in the fuse portion 34 being in an electrical path between the alternator 24 and the first and second batteries 14 and 16. As a result, the alternator 24 can be protected from surges of high current that otherwise could potentially damage the alternator 24. To connect the wires 18, 20, 23 and 25 to the junctions, each wire 18, 20, 23 and 25 can include a forked end 27. The forked ends 27 can extend partially around the bolts 52*a-d* in the example shown in FIG. 2 or the studs 66*a-d* shown in FIG. 2, and the forked ends 27 can be sandwiched between heads of the bolts 52*a-d* and the busbar 28 in the example shown in FIG. 2 and between the nuts 68*a-d* and the busbar 28 in the example shown in FIG. 3. As a result, each wire 18, 20, 23 and 25 can be electrically connected to the busbar 28, with the wire 25 connected to the second conductive portion 32.

The base 40 can additionally define a pair of tabs 50*a* and 50*b* for attaching the electric junction 12 to the vehicle 11. For example, the tabs 50*a* and 50*b* can define apertures 51*a* and 51*b* for receiving bolts. Instead of the tabs 50*a* and 50*b*, other structures can be used for attaching the electric junction 12 to the vehicle 11. A lid 54 can be snap-fit, bolted, or otherwise attached to the housing 40 to cover the busbar 28.

Figure 6:
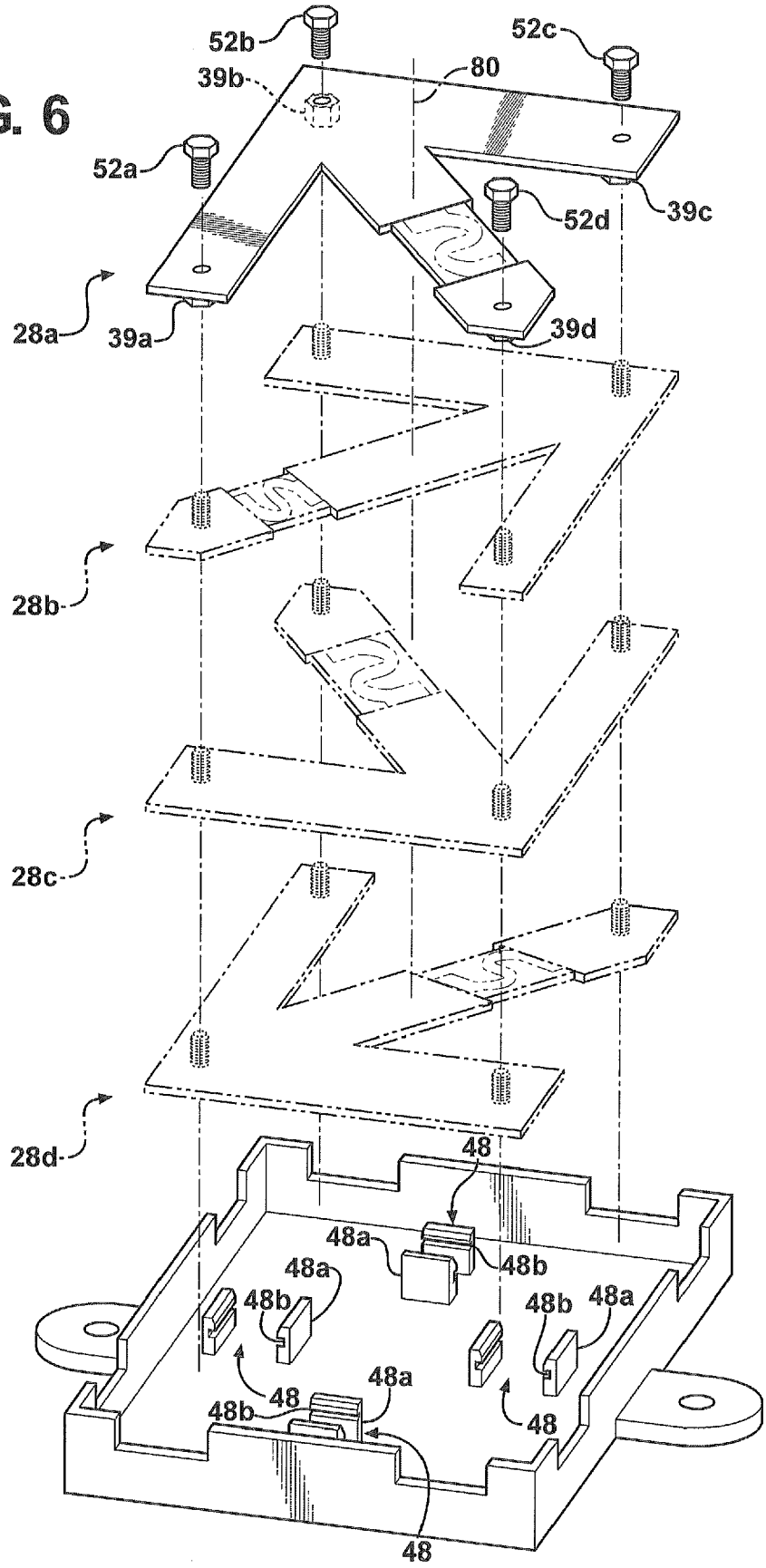
FIG. 6 is an exploded perspective view of the electric junction of FIG. 2 including perspective view of alternative positions in which the busbar can be installed in the housing, with three of the positions in, phantom.

As mentioned above, the junctions can be disposed at corners of the imaginary square 41. Referring now to FIG. 6, an axis 80 can extend orthogonally relative to the imaginary square 41, and the axis 80 can also extend orthogonally to the busbar 28 if the busbar 28 is generally planar. The busbar 28 can be rotated about the axis 80 by prescribed angles (e.g., 90 degrees as shown in FIG. 6, while the busbar 400 show in FIG. 10 is rotatable by 180 degrees) and engaged with at two of clips 48 in different positions. The specific clips 48 engaged by the busbar 28 can vary depending on the position of the busbar 28. Alternatively, other examples of busbars may engage one clip 48 or more than two clips 48. To enable engagement of the busbar 28 and clips 48, the clips 48 can be spaced equidistant from the axis 80 and can be oriented relative to one another by the prescribed angle. That is, in the example shown in FIG. 6, the clips 48 are rotated 90 degrees relative to one another. Additionally, the junctions can be equidistant from the axis 80 such that the junctions occupy predetermined positions regardless of which position the busbar 28 is in. If the junctions are arranged in a shape other than a square, such as a rectangle or parallelogram, not all clips 48 need be equidistant from the axis 80 (e.g., two of the clips 48 can each by spaced from the axis 80 by a first distance and two other clips 48 can be spaced from the axis 80 by a second distance).

The position of any specific junction of the busbar 28 varies in the housing 40 depending on the orientation of the busbar 28. For example, the second conductive portion 32 and its junction can be closer to sidewall 44*b* in a first orientation and closer to sidewall 44*d* in a second orientation. As a result, the distance from the junctions to the batteries 14 and 16, starter 22 and alternator 24 can vary depending on the orientation of the busbar 28 in the housing 40. Further, the lengths of the wires 18, 20, 23 and 25 can vary depending on the orientation of the busbar 28 in the housing 40. That is, the wires 18, 20, 23 and 25 should be long enough to electrically connect their respective components 14, 16, 22 and 24 to the electric junction 12 while keeping their lengths short so to avoid the expenses associated with the cost of excess wire lengths. The specific position in which the busbar 28 is installed in the housing 40 can be selected such that the length, of the wire 18 connecting the battery 14 to the busbar 28 is approximately equal to the length of the wire 20 connecting the battery 16 to the busbar 28. This arrangement can provide relatively equal rates of charging and discharging for both batteries 14 and 16 while keeping the aggregate length of the wires 18 and 20 short.

Additionally, since the busbar 28 can be installed in the housing 40 in different positions, the busbar 28 and housing 40 can be used in multiple models of vehicles having different component lay-outs. The position of the busbar 28 in the housing 40 can vary from vehicle model to vehicle model, with the position selected such that the wires 18 and 20 are approximately the same length. That is, depending on the orientation of the busbar 28 in the housing, the distance between positive terminal 15 of battery 14 and one of the first junctions of the busbar and the distance between positive terminal 17 of battery 16 and another one of the first junctions can both vary. The busbar 28 can be positioned such that those distances are close to equal, thereby allowing the wires 18 and 20 to be of substantially equal length for equal charging and discharging rates of the batteries 14 and 16. Thus, different models of vehicles can be accommodated without the need for an equal number of busbar sizes and shapes.

Figure 7:
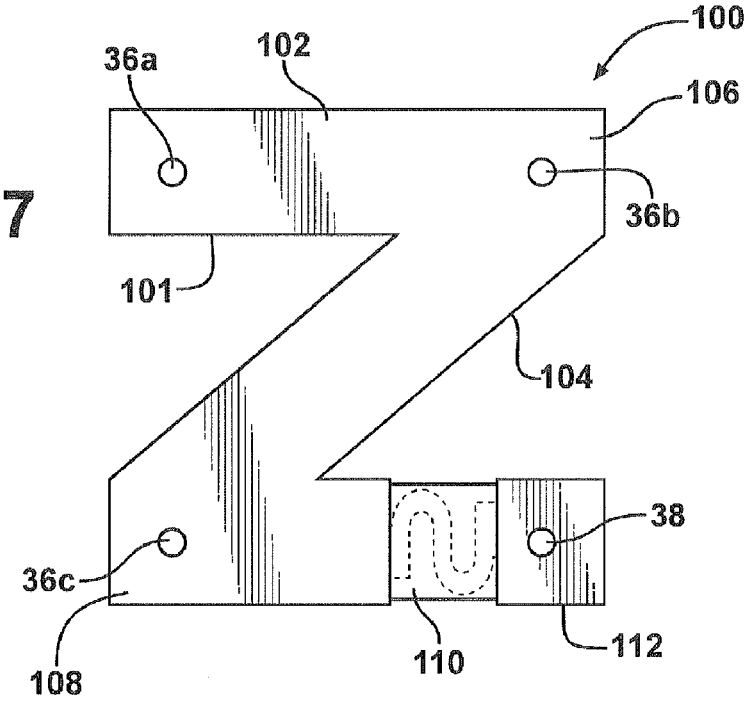
FIG. 7 is a top plan view of another example of a busbar.

While the busbar 28 shown in FIGS. 1-6 has an arrow shape, alternative shapes can be installed in the housing 40 are electrically coupled to the batteries 14 and 16, starter 22 and alternator 24 in the same manner as busbar 28. For example, FIG. 7 shows another example of a busbar 100 having a Z shape. The busbar 100 has a first conductive portion 101 with a first arm 102 and a second arm 104 angled acutely to the first arm 102 and joined thereto at an intersection 106. A fuse portion 110 can connect the first conductive portion 101 to a second conductive portion 112. The fuse portion 110 can be joined to the second arm 104 at an intersection 108, and the fuse portion 110 can extend generally parallel to the first arm 102 and at an acute angle relative to the second arm 104. The second conductive portion 112 can extend from an end of the fuse portion 110 opposite the intersection 108. One first junction including 36*a* can be located near a distal end of the first arm 102 opposite the intersection 106, another first junction including aperture 36*b* can be located near the intersection 106, yet another first junction including aperture 36*c* can be located near the intersection 108, and the second junction including aperture 38 can be located near a distal end of the second conductive portion 112 opposite the intersection 108. The junctions can be arranged in a square, or another shape such as a rectangle or parallelogram depending on the geometry of the busbar 100.

Figure 8:
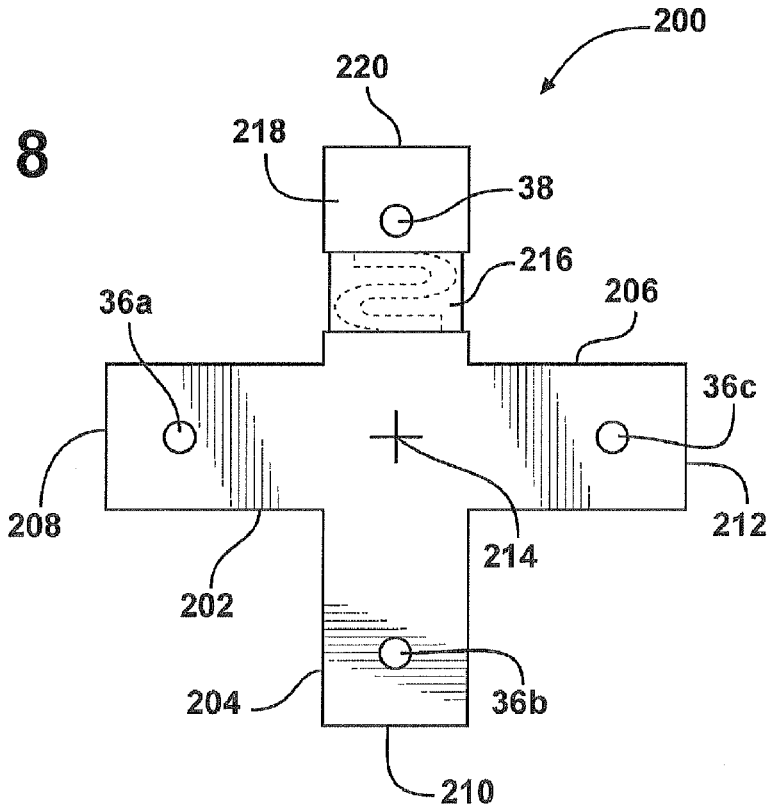
FIG. 8 is a top plan view of yet another example of a busbar.

Yet another example of a busbar 200 having a plus shape is shown in FIG. 8. The busbar 200 includes a first conductive portion having three orthogonally oriented arms 202, 204 and 206 having respective distal ends 208, 210 and 212. The arms 202, 204 and 206 can meet at an intersection 214. A fuse portion 216 can extend from the intersection 214 orthogonally to the arms 202 and 206. A second conductive portion 218 can extend from an end of the fuse portion 216 opposite the intersection 214, and the second conductive portion can have a distal end 220 opposite the fuse portion 216. The first junctions including apertures 36*a*, 36*b* and 36*c* can be located near the distal ends 208, 210 and 212 of the arms 202, 204 and 206, respectively, and the second junction including aperture 38 can be located near the distal end of the second conductive portion 218. The junctions can be arranged in a square, or another shape such as a rectangle or parallelogram.

Figure 9:
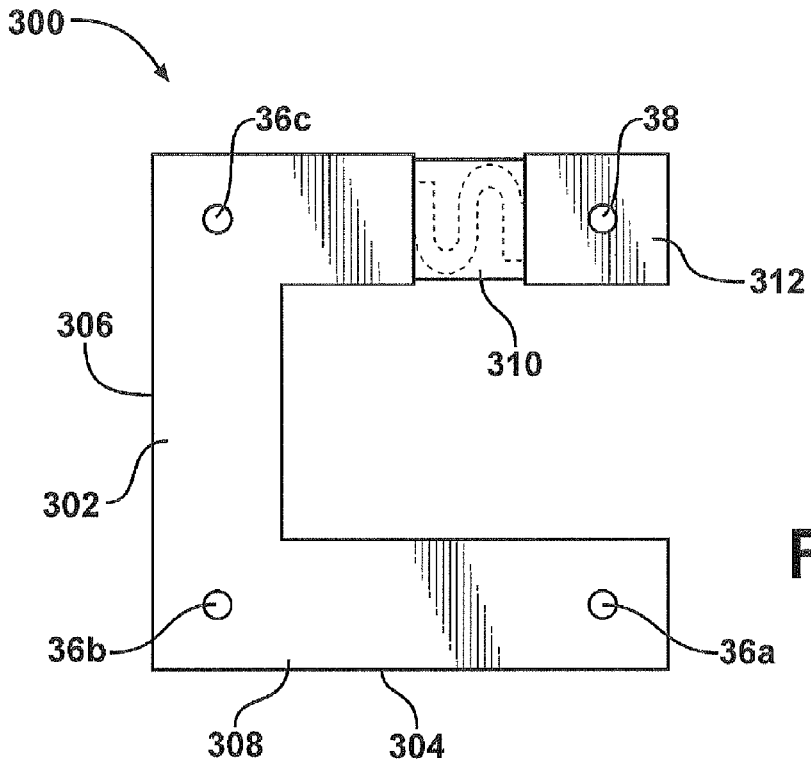
FIG. 9 is a top plan view of still yet another example of a busbar.

Still yet another example of a busbar 300 having a C or U shape is shown in FIG. 9. The busbar 300 includes a first conductive portion 302 having two arms 304 and 306 oriented orthogonally to one another and joined at an intersection 308. A fuse portion 310 can extend from a distal end of the arm 306 opposite the intersection 308. A second conductive portion 312 can extend from an end of the fuse portion 310 opposite the arm 306. One first junction including aperture 36*a* can be located at a distal end of the first arm 304 opposite the intersection 308, another first junction including aperture 36*b* can be located near the intersection 308, still another first junction including aperture 36*c* can be located near the junction of the second arm 306 and the fuse portion 310, and the second junction including 38 can be located near a distal end of the second conductive portion 312 opposite the fuse portion 310. The junctions can be arranged in a square, or another shape such as a rectangle or parallelogram.

FIG. 10 shows another example of a busbar 400 having a C or U shape. However, unlike the busbar 300 in FIG. 9, the busbar 400 in FIG. 10 includes junctions defining the rectangle 53. The busbar 400 includes a first conductive portion 402 having two arms 404 and 406 oriented orthogonally to one another and joined at an intersection 408. A fuse portion 410 can, extend from a distal end of the arm 406 opposite the intersection 408. A second conductive portion 412 can extend from an end of the fuse portion 410 opposite the arm 406. One first junction including aperture 36*a* can be located at a distal end of the first arm 404 opposite the intersection 408, another first junction including aperture 36*b* can be located near the intersection 408, still another first junction including aperture 36*c* can be located near the junction of the second arm 406 and the fuse portion 410, and the second unction including 38 can be located near a distal end of the second conductive portion 412 opposite the fuse portion 410. The busbar 400 can be rotated by 180 degrees for installation in one of two positions in the housing.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which is to be accorded the broadest interpretation so as to encompass all such modifications and equivalent structures as is permitted under the law.

What is claimed is:

1. An electrical coupling for transferring power between a pair of batteries, an alternator, and a starter in a vehicle, the electrical coupling comprising:

a housing including at least one busbar retainer; and a busbar having a first conductive portion, a second conductive portion spaced from the first conductive portion, and a fuse portion connecting the first and second conductive portions, the first conductive portion having at least two spaced apart junctions and the second conductive portion having at least one junction;

wherein the busbar is sized and configured to fit in the housing and engage the at least one busbar retainer in at least first position and a second position in which the busbar is rotated relative to the first position by a prescribed angle about an axis that is perpendicular to an imaginary plane defined by the junctions.

2. The electrical coupling of claim 1, wherein the axis intercepts a polygon having a corners defined by the junctions.

3. The electrical coupling of claim 2, wherein the polygon is a square.

4. The electrical coupling of claim 1, wherein the first portion of the busbar has two arms joined at an intersection and angled relative to one another.

5. The electrical coupling of claim 4, wherein the fuse portion extends from the intersection and is angled acutely relative to each of the two arms.

6. The electrical coupling of claim 4, wherein each arm has a distal end opposite the intersection, and wherein the fuse portion extends from the distal end of one of the two arms and is generally parallel with the other of the two arms.

7. The electrical coupling of claim 4, wherein each arm has a distal end opposite the intersection, and wherein the least two junctions of first conductive portion include a first junction at the intersection, a second junction at the distal end of one of the arms, and a third junction at the distal end of the other of the arms.

8. The electrical junction of claim 1, wherein the busbar is shaped like one of a letter U, a letter Z, an arrow, and a plus-sign.

9. An electrical system for a vehicle comprising:

an electric junction including a busbar defining a first conductive portion having at least two spaced apart first junctions, a second conductive portion spaced from the first conductive portion and defining at least one second junction, and a fuse portion joining the first conductive portion to the second conductive portion;

at least one battery coupled to one of the first junctions; and an alternator coupled to the second junction and operable to charge the at least one battery via the electric junction.

10. The electrical system of claim 9, wherein the electric junction is spaced apart from terminals of the at least one battery.

11. The electrical system of claim 9, wherein the at least one battery includes a first battery and a second battery spaced apart from the first battery, the first and second batteries coupled to separate first junctions.

12. The electrical system of claim 11, wherein the electric junction is approximately midway between the first and second batteries.

13. The electrical system of claim 11, wherein a first terminal of the first battery is coupled to the busbar by a first wire and a second terminal of the second battery is coupled to the busbar by a second wire, and wherein the first wire is approximately equal in length to the second wire.

14. The electrical system of claim 11, wherein the at least two first junctions include at least three first junctions, wherein the electrical system further comprising a starter, and wherein the starter and first and second batteries are coupled to separate first junctions.

15. An electrical system for a vehicle comprising:

a first battery;

a second battery spaced from the first battery;

an electric junction disposed between the first and second batteries;

a first wire coupling the first battery to the electric junction;

a second wire coupling the second battery to the second junction, the second wire of substantially equal length as the first wire;

an alternator, coupled to the electric junction and operable to recharge the first and second batteries via the first and second wires; and a starter coupled to the electric junction and operable to draw power from the first and second batteries via the first and second wires.

16. The electrical system of claim 15, wherein the electric junction includes a busbar having a first conductive portion, a second conductive portion spaced from the first conductive portion, and a fuse portion connecting the first and second conductive portions, the first conductive portion having three spaced apart first junctions and the second conductive portion having one second junction.

17. The electrical system of claim 16, wherein the first and second batteries and the starter are coupled to separate first junctions, and wherein the alternator is coupled to the second junction.

18. The electrical system of claim 16, further comprising a housing including at least one busbar retainer; and wherein the busbar is sized and configured to fit in the housing and engage the at least one busbar retainer in at least a first position and a second position in which the busbar is rotated relative to the first position by a prescribed angle about an axis that is perpendicular to an imaginary plane defined by the junctions.

19. The electrical system of claim 16, wherein the first portion of the busbar has two arms orthogonal to one another and joined at an intersection, and wherein the fuse portion extends from the intersection and is angled acutely relative to each of the two arms.

20. The electrical system of claim 16, wherein the first and second junctions are arranged at corners of an, imaginary square.

* * * * *